US005289695A

United States Patent [19]

Parrish et al.

[11] Patent Number: 5,289,695

[45] Date of Patent: Mar. 1, 1994

[54] ADSORPTION COOLING DEVICE AND METHOD FOR HAZARDOUS MATERIALS SUITS

[75] Inventors: Clyde F. Parrish, Melbourne; Robert P. Scaringe, Rockledge, both of Fla.

[73] Assignee: Mainstream Engineering Corp., Rockledge, Fla.

[21] Appl. No.: 787,880

[22] Filed: Nov. 5, 1991

Related U.S. Application Data

[60] Division of Ser. No. 660,996, Feb. 26, 1991, Pat. No. 5,111,668, which is a continuation-in-part of Ser. No. 593,044, Oct. 5, 1990, Pat. No. 5,113,666.

[51] Int. Cl.[5] ..... F25D 23/12

[52] U.S. Cl. ..... 62/259.3; 62/477; 55/269; 96/154

[58] Field of Search ..... 62/259.3, 261, 235.1, 62/477; 604/312, 113; 2/81, 7, 84, 87, 2; 55/269, 316

[56] References Cited

U.S. PATENT DOCUMENTS

| | | | |
|---|---|---|---|
| 2,024,083 | 12/1935 | Young | 62/480 |
| 4,138,850 | 2/1979 | Tchernev | 62/480 |
| 4,199,959 | 4/1980 | Wurm | 62/480 |
| 4,660,629 | 4/1987 | Maier-Laxhuber et al. | 62/480 |
| 4,856,294 | 8/1989 | Scaringe et al. | 62/259.3 |

*Primary Examiner*—John M. Sollecito

*Attorney, Agent, or Firm*—Evenson, McKeown, Edwards & Lenahan

[57] ABSTRACT

A relatively lightweight cooling device and method utilizing adsorption of perspirated water vapor to permit evaporative cooling of a person wearing a sealed suit for defined time periods. The device can be constructed in the form of a rectangular pad or the like having an open cell foam adjacent the person's skin to permit static transport of perspirated water vapor to an adsorbent layer. The open cell foam or a separate material acts as a thermal insulator to prevent heat flow back toward the skin resulting from the exothermic heat of adsorption produced by the adsorbent layer. In lieu of static movement of the water vapor, a small fan can be operatively associated with the fan for actively moving the water vapor to a single point to enhance the evaporative cooling, particularly where a smaller amount of adsorbent material is used. The vest itself can be the evaporator and filled with working fluid which is vaporized as the evaporator section of the vest absorbs heat from the body; the vapor is transported to a bed which can contain a desiccant, molecular sieve, adsorbent or absorbent material. Alternatively, the wearer's vest can be the adsorbent bed of the system initially completely charged with a working fluid which is driven off the bed as a result of the generation of body heat. The vapor can be transported from the bed to an internal heat exchanger or directly to the environment, e.g. outer space.

14 Claims, 5 Drawing Sheets

ADSORPTION COOLING DEVICE AND METHOD FOR HAZARDOUS MATERIALS SUITS

CROSS-REFERENCE TO RELATED APPLICATION

This is a divisional of application Ser. No. 07/660,996, filed Feb. 26, 1991 now U.S. Pat. No. 5,111,668. This is a continuation-in-part of application Ser. No. 07/593,044, filed Oct. 5, 1990 now U.S. Pat. No. 5,113,666.

BACKGROUND AND SUMMARY OF THE INVENTION

The present invention relates to a cooling mechanism and method used in a garment such as a suit or vest, as well in a head covering. More particularly, the present invention is directed to cooling devices such as vests, pads or patches used as a new cooling method in, for example, space suits, moisture-tight sealed hazardous material suits, vests and the like in which interior temperature and perspiration increases with physical exertion such as may be encountered in outer space extra vehicular activities, mining operations, fire departments and hazardous material disposal, or in adsorption-type hazardous material suits that are loose fitting.

U.S. Pat. No. 4,856,294, shows a lightweight cooling vest which uses phase change materials to keep the wearer relatively cool under relatively heavy workload conditions for several hours. The materials act as a thermal diode which draws heat away from the surface of the skin but which also provides an insulating barrier to prevent unwanted cooling of the skin should the skin temperature drop below the phase transition temperature of the material.

Although the cooling vest is quite adequate for use in a vest or similar type of garment, the use of phase-change materials does not provide a sufficient cooling effect in connection with garments used in hostile environments such as may be encountered, for example, with hazardous material suits which must be sealed and therefore moisture-tight or adsorption-type hazardous material suits that are loose fitting but that cannot be opened or removed in a hostile environment. By way of illustration, the phase-change material is capable of handling 200–300 kJ per kilogram of material. Although this is acceptable with open garments such as vests, it is not sufficient with respect to sealed garments such as hazardous materials disposal suits OR SPACE SUITS and the like where moisture cannot escape and there is a significant heat build-up.

Therefore, an object of the present invention is to provide a relatively lightweight cooling mechanism and method for use with sealed garments, but not limited to use to use with sealed garments, which will provide an adequate cooling effect for a person wearing such a garment and engaging physical exertion which produces substantial amounts of perspiration.

The foregoing object has been achieved in accordance with the present invention by utilizing the transport of water vapor from the skin or in a closed system to a desiccant bed which adsorbs the water and produces exothermic heat toward the outside of the suit.

In particular, AN EMBODIMENT OF the present invention utilizes a cooling pad which is attached to a desiccant bed for adsorbing evaporated water from the person wearing the suit. The desiccant is located immediately adjacent to the outer surface of the garment and an open cell thermal insulation layer adjacent an opposite surface of the desiccant material to provide a barrier for resistance to heat flow from the exothermic adsorption process from the desiccant back toward the person's skin. This open cell foam between the person's skin and the thermal insulator permits the passive transfer of water vapor from the skin to the desiccant material where it is adsorbed and, when appropriate, itself to act as a thermal insulation barrier to prevent a backwards heat transfer.

As is well known, evaporation of water vapor from a person's skin requires a latent heat of vaporization which provides an overall cooling effect for the person's body. A thermal insulation layer can comprise, for example, a fine mesh nylon open-cell foam polyurethane foam composite so as to decrease by a large factor the heat flow from the absorption layer back to the wearer's skin where heat is created from the exothermic adsorption process. The desiccant bed can be formed, for example, by heat sealing the desiccant material in a plastic bag, which can be opened to initiate the adsorption process, attached by adhesive or the like to the inside of the hazardous materials handling suit. The bag can be then be discarded after use for the intended period, say six hours, or regenerated.

An advantage of the aforementioned embodiment of the present invention is that the cooling mechanism moves the water as vapor through the open cell foam and allows moisture to pass therethrough to the desiccant bed. As previously noted, the open cell foam can act as a thermal insulator depending on the material chosen; or the pad can have a separate material such as a product sold under the trademark "THINSULATE" by the 3M Company, between the open cell foam and the desiccant bed.

Another advantage and feature of the present invention is that the process of evaporation is substantially endothermic so that an adequate cooling capacity may be achieved within practical weight limitations.

Yet another feature of the present invention is that good thermal insulation is provided next to the skin of the person wearing the garment whereas relatively poor thermal insulation is provided at the outside of the suit so that, although the suit is moisture tight, the heat differential existing between the inside of the desiccant bed and the outside of the suit is high enough to cause the heat to flow in only one direction, namely toward the outside of the suit.

According to still another feature of the present invention, the cooling device may be provided in the form of a quilted pad, the quilting being provided so that the desiccant material will not settle to the bottom of the pad but be confined to a smaller space within the pad. The surface of the pad intended to be attached to the suit can have a self-adhesive surface so that the interface between the desiccant bed and the suit material provides a relatively good heat transfer surface. Another surface of the pad adjacent the open-cell foam which can be a polyurethane can be a peelable film such as polyethylene which can be peeled away to initiate the cooling process by permitting the transport of water vapor and prior thereto to provide shelf-life for the pad.

According to another aspect of the present invention, the cooling pad or pads can be adhered to the front and back of the suit, i.e., the chest area and the back areas. If the suit also has a head piece, a cooling pad can be placed in the vicinity of the top of the head where a substantial proportion of perspiration will occur in relation to the body area of the person. Alternatively, if the use of other equipment either on the chest or the back of the person wearing the suit precludes putting cooling pads in those areas, the cooling pads can be adhered to the suit at the sides.

To further minimize the weight of the cooling pad, particularly in a small area such as the head, a small commercial fan can be employed to pull water to a single point. The fan can be battery operated by, for example, a 12-volt battery.

A cooling pad of practical weight, i.e., ten pounds or less, can hold 40% of its weight in water which adsorbs 800 KJ of energy per kilogram of desiccant material with the known cooling vest which has a capacity of 200--300 KJ per kilogram of phase-change material.

According to another embodiment of the present invention, the cooling device and method may be embodied in a cloth covered open-cell foam, which is backed with a polymer film, so that moisture can enter the foam from the skin side and then be transferred through the foam to the desiccant bed with a battery operated fan. In this embodiment the desiccant bed is located outside the suit. The moisture in the air is removed by the desiccant and the heat generated by the hydration would be transferred through the desiccant bed case to the outside. The desiccant bed is provided with baffles to improve the heat transfer and moisture removal. The dry air can be cooled either by a finned pipe, or returned untreated to the suit and distributed through the cloth covered open-cell foam. This return air maintains a constant pressure in the suit to prevent outside air from entering. The desiccant in the desiccant bed can be any commercially available desiccant.

Another embodiment of the personal cooling device utilizes only one moving part, namely a spring-actuated pressure regulating valve. Working fluid is evaporated from a sealed vest and captured in an absorbent or adsorbent bed which rejects heat to the environment. Rather than use the wearer's perspiration as the working fluid, a self-contained working fluid is used. Although this system requires the additional mass of this working fluid, the rate of adsorption of the working fluid vapor on the bed is increased because no other gases are present in the system to impede this adsorption. Also, this embodiment has the option of using fluids other than water as the working fluid.

In yet another embodiment of the present invention, working fluid is desorbed from an adsorption bed, thereby providing the cooling and capture of this working fluid in an external heat exchanger, such as a condenser, which rejects heat to the environment. For space applications, the working fluid can be exhausted to the vacuum of space instead of being captured. This approach is ideal for a space suit cooling system where the working fluid would be desorbed from the adsorption bed to provide the cooling and the desorbed vapor is dumped to the surrounding space environment. The adsorbent bed could be configured to be a vest, or it could be an intermediate heat exchanger between the cooling system and the wearer. This approach is different from the above-described sealed vest with pressure regulating valve in which the vest is the evaporator and the vapor is driven off the evaporator and trapped in the adsorbent bed where heat is rejected. The desorption embodiment uses a recharging scheme similar to the sealed vest embodiment since in the recharge mode thereof, the bed is heated (adsorbing energy) and drives the working fluid off the bed (adsorbing energy or cooling in the process) and back into the vests which acts as a condenser.

BRIEF DESCRIPTION OF THE DRAWINGS

These and other objects, features and advantages of the present invention will become more apparent from the following detailed description of presently preferred embodiments when taken in conjunction with the accompanying drawing wherein.

DETAILED DESCRIPTION OF THE DRAWINGS

Figure 1:
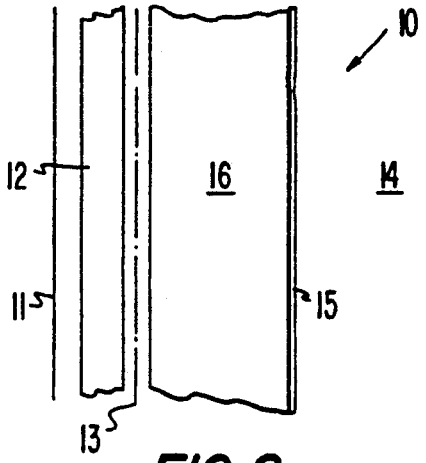
FIG. 1 is a partial, cross-sectional schematic showing of a typical construction of a cooling pad according to the present invention.

Referring now to FIG. 1, there is shown a partial, cross-section of the cooling pad in accordance with the present invention designated generally by the numeral 10. The pad 10 is shown somewhat schematically to illustrate the basic constructional features which in themselves are known material and includes in the area adjoining the skin 11 an open-cell foam 12 such as polyurethane which permits the transfer of evaporated water from the skin toward the outside of the suit. A thermal insulation layer shown by dotted lines 13 can be provided next to the open-cell foam 12. The layer 13 can be in the form of a separate piece of nylon mesh or screen or a material sold under the trademark "THINSULATE" by the 3M Company. Alternatively, the thermal insulation can be part of the open-cell foam 12. The thermal insulation provides a relatively high resistance to flow of the heat from the adsorbent bed to the skin 11 toward the outside 14 of the suit 15. An adsorption layer 16 is provided between the open-cell foam 12/thermal insulation 13 and the suit skin 15. The layer 16 comprises a desiccant, e.g., molecular sieves, magnesium chloride, silicon gel, calcium chloride, alumina, calcium sulfate, magnesium nitrate, or other known desiccants. In adsorbing the water vapor from the skin 11, the adsorption process produces a substantial amount of exothermic heat of absorption. The thermal insulation constituted by or the open-cell foam 12 itself or a sheet adjacent the open-cell form assures that the exothermic heat produced by the adsorption layer 16 does not flow from the adsorption layer back toward the person's skin through the open-cell foam. The thermal resistance between the adsorption bed 16 and the open cell foam is sufficiently high to assure heat flow primarily in the direction toward the outside 14.

Thus, as water is evaporated from the skin of the individual wearing the hazardous material suit, it passes through the open-cell foam layer 12 (as well as the thermal insulation 13 where provided) and is adsorbed in the desiccant bed 16. The desiccant bed has now been isolated thermally from the person by use of the thermal insulation 13 so that the exothermic heat of adsorption is radiated to the outside 14 of the suit, and the skin-surface evaporation process provides the latent heat of vaporization of the water to provide the cooling effect.

Figure 2:
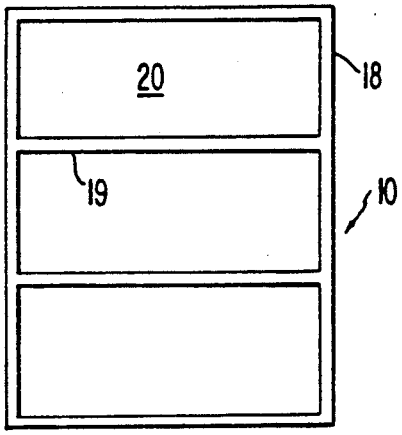
FIG. 2 is a front elevational view of a quilted pad constructed in the manner similar to the pad shown in FIG. 1.
Figure 3:
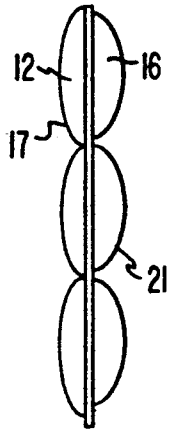
FIG. 3 is a side view of the cooling pad shown in FIG. 2

In a practical embodiment of the present invention, as shown in FIGS. 2 and 3, the exposed face of the open-cell foam will be provided with a plastic film 17, such as polyethylene, which is peelable to expose the desiccant and allow vapor transfer when needed to initiate cooling in the suit. The film 17 allows the pad to be stored or inventoried so as to give it greater shelf life. It is seen that the pad 10 has a quilted appearance created by heat sealing at edges 18 and at the intermediate areas 19 in a known manner because the powder or pellet desiccant will be confined to smaller pouches 20 rather than tend to flow down toward the extreme bottom end of a single pouch. The side of the desiccant layer 16 which faces the inner surface of the suit 15 can have an adhesive which is covered with a peelable material such as paper so that upon installation in the suit the paper can be peeled off and the pad 10 attached to the suit interior. The outer surface covering the layer 16 can be a known polymer film.

Figure 4:
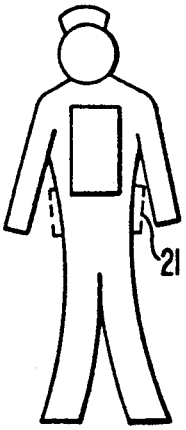
FIG. 4 is a schematic view of the back of a person wearing a suit into which the cooling pad has been attached.
Figure 5:
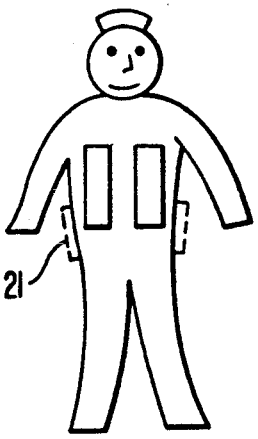
FIG. 5 is a view similar to FIG. 4 but showing the front the person.

As shown in FIGS. 4 and 5, the pads 10 can be of various sizes. By way of example, a large pad can be inserted at the wearer's back (FIG. 4) and/or two smaller pads can be inserted at the wearer's front (FIG. 5) depending upon considerations such as weight and comfort. If, for some reason, it is impractical to put the pads at the front or back, they can be placed at the sides as shown by the dotted lines 21.

Figure 6:
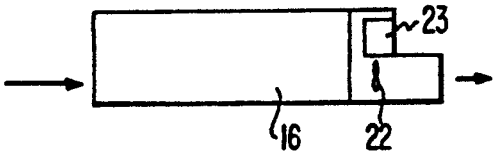
FIG. 6 is a schematic elevational view of a cooling pad which uses a small fan powered by a 12 volt battery and can be used, for example, in a head piece or helmet of a sealed suit.

In the event that a cooling pad is used in the head portion of the suit, a mechanical device such as a small, commercially available fan 22 can be employed to pull the water to a single point and move the moisture to the molecular sieve bed 16 for more efficient cooling as shown in FIG. 6. The fan can have a 15 cfm capacity which is relatively lightweight and uses a 12 volt, AA size nickel-hydride battery 23. The fan can also be necessitated where it is decided to use to a smaller amount of desiccant material because weight is an important consideration. The fan provides sufficient capacity for proper thermal loading by kinetically rather than passively transferring water vapor from the body to the adsorbent material.

Figure 7:
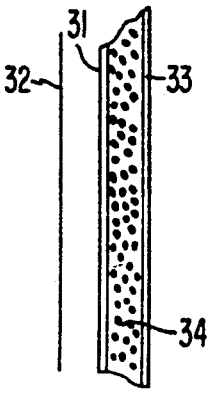
FIG. 7 is a partial, cross-sectional schematic showing a vest material which can be used with a garment which is not sealed at the waist.
Figure 8:
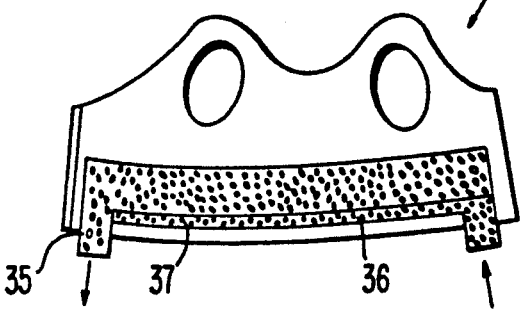
FIG. 8 is an elevational view of the vest constructed in the manner shown in FIG. 7.
Figure 9:
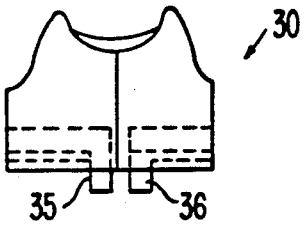
FIG. 9 is a elevational view of the vest of FIG. 8 but in the closed, wearing position.
Figure 10:
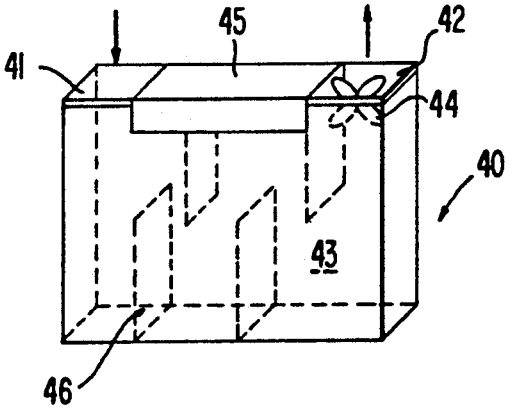
FIG. 10 is a perspective schematic view of a baffled water trap with a desiccant bed and a fan.

In yet another embodiment of the present invention used with a suit that does not require sealing, the cooling arrangement can be in the form, as shown in FIG. 7, of an open-cell foam 34 of, for example, a thickness of ½" covered on one side by a very open weave cotton cloth 31 which is placed next to the skin 32 of the person wearing a conventionally-shaped vest of the type shown in FIGS. 8 and 9. The other side of the foam layer 34 can have a water-impervious thin polymer film 33 heat sealed thereto. In this embodiment, the desiccant bed for adsorption is outside the vest and can be provided in a case designated generally by the numeral 40 in FIG. 10. The case 40 can be attached to a belt or the like.

The foam material 34 is comprised of two L-shaped pieces 35, 36 as shown in FIG. 8. The feet of the L-shaped members 35, 36 are disposed essentially vertically and form an outlet and inlet (shown by arrows) which mate with an inlet and outlet 41, 42, respectively, at the top of the case 40. A barrier layer 37 separates the two L-shaped portions 35, 36 so that moisture evaporated from the skin of the person is uniformly passed to the open-cell foam layer 34 substantially over the entire horizontally disposed leg of the portion 35 by the very open weave cloth 31 which also provides comfort. The barrier layer 37 can be formed by applying heat to the interface between the portions 35, 36 at the time of heat sealing the film 33 on the outer surface. The moisture is transported out of the portion 35 in the direction of the downwardly directed arrow in FIG. 8 to the inlet 41 of the case 40 which fits over the foot of the portion 35 extending from the vest 30 shown in FIG. 9.

As previously noted, the interior 43 of the case 40 is filled with a desiccant. By way of example, the desiccant materials can be alumina, calcium sulfate, silica gel, magnesium chloride, magnesium nitrate, molecular sieves, copper sulfate, barium hydroxide, calcium chloride, cupric nitrate, ferric ammonian sulfate, ferrous ammonium sulfate, magnesium acetate, magnesium sulfate, nickel sulfate, potassium carbonate, tetra sodium borate, sodium carbonate, sodium phosphate, sodium pyrophosphate, sodium sulfate, or zinc sulfate. The case is also provided with a fan 44 which is operated by a 12 volt battery 45 located between the inlet 41 and the outlet 42. To improve transfer of the heat of adsorption produced in the case 40 and thus moisture removal, baffles 46 can be arranged in the interior 43 of the case 40. The air which has passed through the desiccant bed is now relatively dry and can either be returned to the portion 36 in the garment 30 without further treatment or passed through a finned pipe if the exothermic adsorption process produces an excessive amount of heat. The return air stream produced by the fan 44 in the direction of the upwardly directed arrow in FIG. 8 maintains a constant pressure in the garment to resist outside air from entering.

Figure 11:
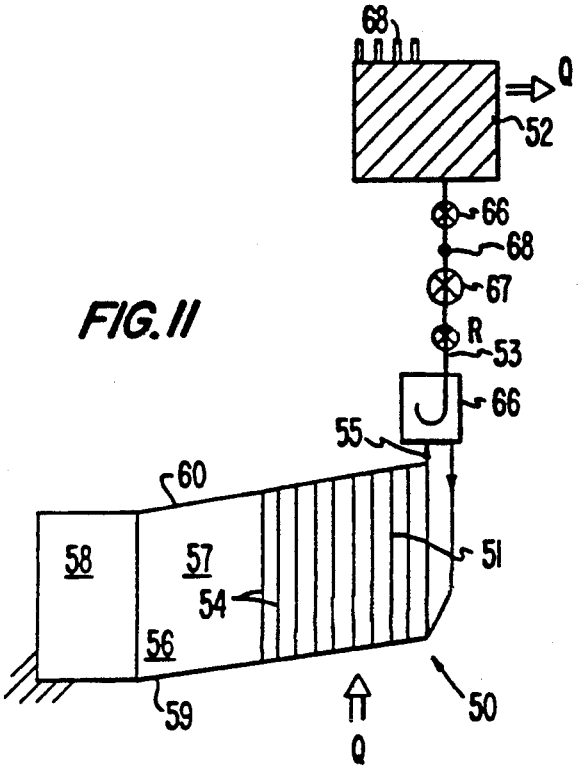
FIG. 11 is a schematic drawing of another embodiment of the cooling system of the present invention in which the vest itself is the evaporator.

In the embodiment of FIG. 11, the wearer's vest 50 is actually the system evaporator. This vest is initially completely filled with the working fluid, and as the system absorbs heat from the body, this working fluid is vaporized. This vapor is transported from the evaporator section 51 to the adsorbent (or absorbent) bed 52 by a pressure difference between the evaporator section 51 and the bed 52. By way of example, the desiccant materials can be alumina, calcium sulfate, silica gel, magnesium chloride, magnesium nitrate, molecular sieves, copper sulfate, barium hydroxide, calcium chloride, cupric nitrate, ferric ammonium sulfate, ferrous ammonium sulfate, magnesium acetate, magnesium sulfate, nickel sulfate, potassium carbonate, tetra sodium borate, sodium carbonate, sodium phosphate, sodium pyrophosphate, sodium sulfate, or zinc sulfate. A known type of spring-actuated pressure regulating valve or thermal expansion valve 53 maintains the desired pressure in the evaporator 51 this pressure being determined from the desired temperature in the vest 50 and the saturated pressure-temperature relationship of the particular working fluid. For example, if the working fluid is water and the desired temperature is 20° C. (68° F.), then the pressure regulating valve would be set to maintain a pressure of 2.3 kPa (0.33 psia) in the evaporator section 51. Alternatively, if the working fluid is R-12 and the desired temperature is 20° C. (68° F.) then the pressure regulating valve would be set to maintain a pressure of 567 kPa (82 psia) in the evaporator section 51.

The adsorbent bed 52 will always maintain a vapor pressure below this pressure as long as the bed is not saturated. The vest 50 is configured as a parallel passage heat exchanger 54, so as the working fluid is vaporized, the liquid-level drops. The passage 54 can be configured to be vertical or inclined slightly from the vertical orientation to promote the transport of vapor bubbles to the vest's vapor outlet 55. The vest 50 contains saturated working fluid with saturated liquid 51 in the lower section 56 and saturated vapor in the upper section 57. The liquid level continues to drop until all the liquid has vaporized and the cooling capacity of the system (via evaporation) has been exhausted.

The volume of water necessary for the system is determined by the total cooling requirement (i.e., cooling rate multiplied by cooling time). If this required volume of liquid working fluid cannot be accommodated within the vest 50, then an additional chamber 58 can be connected to the vest 50. The vest and this optional chamber 58 are initially filled completely with liquid working fluid. This chamber should have both a bottom liquid connection 59 and an upper vapor connection 60. The vapor connection is necessary so that vapor can enter the chamber to replace the volume of liquid that leaves without the need for flashing the liquid which could freeze this chamber if it is insulated. This additional chamber can be insulated (adiabatic) so that cooling only occurs from heat exchange between the vest and the body. Alternatively, this chamber can be in thermal communication with the body or any other item requiring cooling (i.e., electronics, radio, etc.).

Figure 12C:
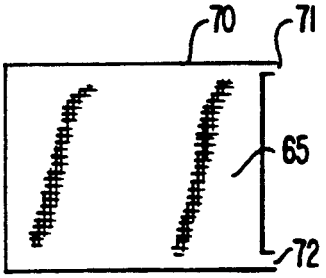
FIG. 12C shows the vest using the cooling system of FIG. 11 as a continuous flexible impervious material.
Figure 12A:
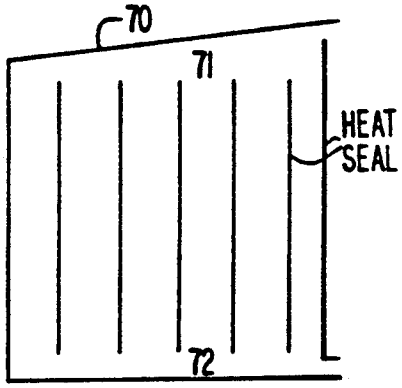
FIG. 12A is a schematic showing of an evaporator section for the system of the present invention shown in FIG. 11, wherein the evaporator is above ambient pressure.
Figure 12B:
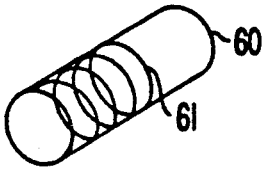
FIG. 12B is a schematic perspective showing of a coiled support for the evaporation passages in the vest.

The vest 50 can be manufactured with multiple small passage connected in parallel to a lower liquid and upper vapor manifold. These passages can then be sandwiched in a cloth garment to form a vest, or the vest can be configured as a continuous flexible impervious material, such as polyethylene or polyvinyl chloride, as shown in FIG. 12A which has a heat sealed perimeter 70, vapor manifold 71, and a liquid manifold 72. The configuration of FIG. 12A is for a system whose evaporator is above ambient pressure, and therefor, there is no concern that the passages of the flexible vest will collapse and restrict the flow. In those cases where the internal pressure exceeds the ambient pressure, the evaporator can have a semi-ribbed appearance created by heat sealing at intermediate areas in a known manner to minimize the spreading of the vest. Alternatively, an external flexible support material such as fabric can be used for evaporator pressures which exceed atmospheric pressure. If the pressure in the evaporator 51 (for the desired evaporator temperature) is below ambient pressure (sub-ambient), then the passage 60 must be designed as shown in FIG. 12B with a ridged passage of coiled support 61 to prevent collapse. For the case of the continuous flexible impervious (polyethylene o polyvinyl chloride) evaporator (and/or the optional fluid chamber) which contains the sub-ambient evaporating working fluid, a porous flexible material 65 (such as open-cell polyurethane foam}contained inside can be used to prevent collapse of the passage (FIG. 12C).

The absorbent or adsorbent bed 52 of the system is configured to accommodate the total volume of working fluid vapor which exits the evaporator during operation. The adsorption or absorption of working fluid vapor is typically exothermic so this chamber will reject heat to the environment and can have fins 63 to promote cooling. Forced convection via a fan can also be used.

A liquid accumulator 66 is also used between the evaporator 51 and the adsorbent bed 52 to prevent liquid from entering the bed 52 during transient temporary tilting of the system (for example, when the wearer bends over). Other more sophisticated valves, to sense tiling and shut the system off, could also be used. The liquid accumulator 66 should be placed between the evaporator 51 and the pressure regulating valve 53 and plumbed so that the liquid returns to the lower liquid manifold as shown in FIG. 11.

The system is recharged by removing the system from the wearer and placing it on a recharge stand. This stand will consist of a heat source which could be fuel fired, such as a ceramic-wick kerosene or diesel heater, or electrically heated, e.g., by resistance heating. The heat could flow by either natural or forced circulation to heat the bed 52 and drive the vapor off the bed and back into the vest section 51 which is now acting as a condenser. During the cooling operation, the vest behaves as an evaporator and during recharge the vest behaves as the condenser. The wearer does not wear the system during recharge. The condenser will reject heat to the surroundings. If the vest were first washed, prior to this recharging, the moist vest material would promote recharging and the heat rejection from the vest would promote drying.

As an alternative recharge scheme, the system could be disconnected at disconnect valves 66, 67. The bed 52 can be dried via oven heat, evacuated of air and sealed by closing the valve 66, and the vest could be cleaned, filled to capacity with liquid working fluid and the valve 67 closed Quick-disconnects which automatically seal the plumbing lines could be incorporated to simplify the procedure by replacing these disconnecting valves 66, 67 and coupling 68 with self-sealing couplings.

By way of example only, a cooling requirement of 300 W for 6 hours, using water as the working fluid, 2.6 kg of water must be contained in the vest 51 and the optional chamber 58. An adsorbent material of magnesium chloride with an adsorption capacity of 60% results in a bed mass of 4.3 kg. This leads to a total fluid and bed mass of 6.9 kg. If the container and hardware mass totals 1 kg, this leads to a total fluid and bed mass of 7.9 kg (17 lbs.). The bed would have to reject heat at a rate of approximately 600 W, and with a heat rejection temperature difference (between bed outside surface and ambient air) this results in a natural convection area requirement of less than 1 $m^2$ of finned surface.

Figure 13:
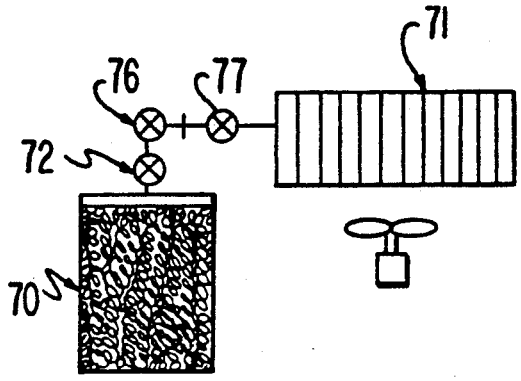
FIG. 13 is a schematic drawing of yet another embodiment of the cooling system of the present invention in which the wearer's vest is the adsorbent bed of the system.

According to another embodiment of the present invention as shown in FIG. 13, the wearer's vest 70 can be configured to be the adsorbent bed of the system. This adsorbent bed is initially completely charged with the working fluid. As the system absorbs heat from the body this working fluid is driven off the bed (desorption). This vapor is transported from the bed (cooling section) to an external heat exchanger 71, which behaves as a condenser. The driving force for this vapor transport is a pressure difference between the adsorbent bed 70 and the condenser 71. Thermal control of the cold surface cannot be controlled by a pressure regulating valve such as valve 53 in FIG. 11, since with desorption, unlike evaporation, pressure and temperature are independent variables. The cold surface can be controlled by a simple temperature actuated valve, such as a bi-metallic actuated valve 72. The valve 72 is temperature controlled, user controlled, or controlled by some other parameter, and shuts off the exit flow of vapor from the adsorbent bed 70. In the case of a temperature controlled valve, when the desorbing bed 70 becomes too cold, the valve 72 is closed. Since the vapor is no longer allowed to leave the bed chamber, the vapor pressure in the bed chamber rises and the vapor reaches saturated vapor conditions. At this point no more vapor will desorb since the chamber contains saturated vapor and so the desorption will stop.

There are other control techniques that could also be used within the scope of the present invention. In addition, for the application where the adsorbent bed is being used in a vest directly against the wearer, a phase change material between the wearer's skin and the bed, similar to the technique used in U.S. Pat. No. 4,193,441, could be employed. The necessary characteristics of the phase change material are that it must melt at the desired temperature, have good thermal conductivity in the liquid phase, and poor thermal conductivity in the solid phase. Thus, when the bed attempts to cool the wearer below the thermally comfortable desired temperature, the phase change material solidifies, and then because of the poor solid phase thermal conductivity insulates the wearer from further cooling. As the wearer's skin again heats up, the phase change material melts allowing thermal communication between the wearer and the desorbing bed, thereby allowing the bed to provide additional cooling. In this configuration, thermal control is obtained by controlling the heat transfer to the adsorbent vest, and a valve between the adsorbent bed and the external heat exchanger would not be needed, although it could still be used to provide yet another level of thermal control. For applications where the adsorption bed is not in direct contact with the wearer but instead cools a secondary heat transfer loop, the flow of this fluid could be interrupted when no additional cooling is needed.

Figure 14:
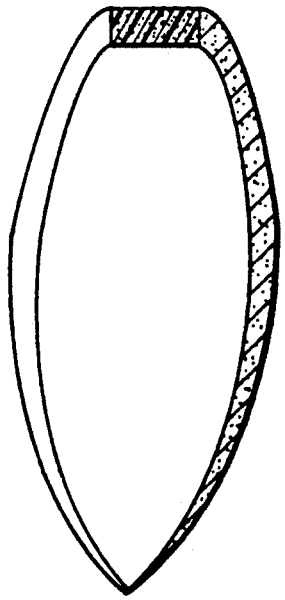
FIG. 14 is a schematic cross-sectional view of the construction of the vest shown in FIG. 13.

The adsorbent bed 70 (vest or heat exchanger) is configured as a porous bed of adsorbent particles. Vapor flow passages can be increased by the introduction of porous material within the bed, but this is not necessary in most applications. The vest can enclose the adsorbent material in a continuous flexible impervious material such as polyethylene or polyvinyl chloride, as shown in FIG. 14. If the pressure in the bed for a desired evaporator temperature is below ambient pressure (sub-ambient), then the passages are constructed to prevent collapse thereof. This may be accomplished by the inherent compressive strength of the adsorbent particles, or additional support may be needed. This depends on the adsorbent, and working fluid used. Insulation could be incorporated on the outside of the vest 70, to reduce the heat gain from the environment, and as discussed previously, phase change material can be sandwiched between the wearer's skin surface and the adsorbent bed 70 in a separate impervious packet to provide thermal control without the use of a valve. Alternatively, for bed pressures which exceed atmospheric pressure, an external flexible (i.e., fabric) support material could be used.

The external heat exchanger 71 is used when the system is to contain and recycle the working fluid. Its purpose is to capture and re-condense the working fluid. For a extra-vehicular-type space suit where weight and size are important it may be advantageous to use the alternative approach, namely to exhaust the desorbed working fluid into the vacuum of space. The desorbed and exhausted fluid could be a water or some other non-toxic fluid so this does not cause any safety concerns. When the external heat exchanger is utilized, it must accommodate the total volume of working fluid vapor which exists the adsorbent bed during operation. The condensation process is exothermic so this heat exchanger 71 will reject heat to the environment and can be finned to promote cooling. forced convection via a fan could also be used.

In this embodiment, the system is again recharged by removing the system from the wearer and placing it on a recharge stand. This stand will again consist of a heat source which could be fuel fired, such as a ceramic-wick kerosene or diesel heater, or electrically heated by resistance heating. The heat could flow by either natural or forced circulation to heat the external heat exchanger 1 which during recharge is acting as an evaporator but during normal operation is acting as a condenser. During recharge, the working fluid evaporated from the external heat exchanger 71 is forced into the adsorbent bed 70 which is now adsorbing working fluid and must be cooled. During the cooling operation, the adsorption bed is desorbed providing the cooling, and during recharge the adsorption bed adsorbs working fluid. Of course, the wearer does not wear the system during recharge. This adsorption bed (vest or cold plate) will reject heat to the surroundings during recharge. If the vest were first washed, the moist vest material provides, prior to recharging cooling, and the heat rejection from the vest promotes drying.

As an alternative recharge scheme, the system could optionally be disconnected at disconnect valves 76, 77 as shown in FIG. 13. The bed is then saturated with working fluid, evacuated of air and excess working fluid, and sealed by closing valve 76. If an external heat exchanger is used, it is cleaned, evacuated, and the service valve 77 is closed. Quick-disconnects which automatically seal the plumbing lines could be incorporated to simplify the procedure by replacing the disconnecting valves and coupling with a self sealing coupling.

Some representative size calculations can be performed for the embodiment of FIG. 13. A cooling requirement of 300 W for 6 hours, using water as the working fluid, and magnesium chloride as the bed material (adsorption capacity 113%) results in a bed mass of 0.33 kg. This requires a total fluid and bed mass of 0.71 kg which is initially all stored in the bed. If the container and hardware mass totals 1 kg, this leads to a total fluid and bed mass of 1.71 kg (3.76 lbs).

Figure 15:
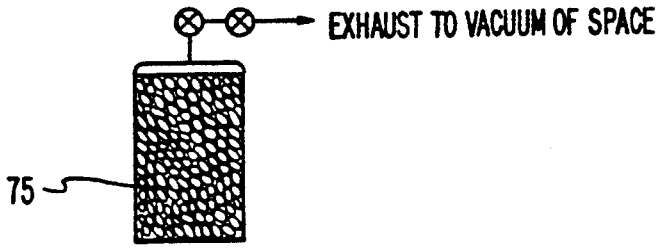
FIG. 15 is a schematic drawing of an embodiment similar to FIG. 13, which exhausts the working fluid directly to the environment.

It will be understood that the system of FIG. 13 is somewhat similar to that of FIG. 11, except that the cooling and recharge operations are reversed. Moreover, in the FIG. 13 system, the cooling is provided by desorbing working fluid from a adsorption or absorption bed 70 and recapturing this working fluid in an external condenser 71 for subsequent recharge. However, a further modification would be to not capture this working fluid, but rather simply to exhaust this working fluid to the environment, as shown in FIG. 15, where the cooling is obtained by desorbing working fluid from an adsorbent bed 75, which is the vest (or a heat exchanger in the area to be cooled), and the working fluid is exhausted into the environment. This approach is particularly well suited for a spacesuit cooling system which would be used for extra-vehicular operations and would exhaust to a vacuum. Numerous working fluids and adsorbent (or absorbents) exist for this application. Furthermore, because the heat of desorption is greater than the heat of vaporization, these cooling systems are extremely lightweight. Since there are numerous nontoxic working fluids and adsorbents, the system also does not present any potential "out-gassing" or safety issues. For a spacesuit application, the adsorbent bed can be in the form of a vest worn under the suit, or the adsorption bed could be configured as a heat exchanger which transfer energy between the proposed adsorption cooling system and the body via a secondary coolant loop. This secondary heat transfer loop could be a typical water loop, or the breathing air could be cooled, or a combination of both methods.

For this working fluid exhausting system, recharge could consist of resaturating the adsorbent bed with working fluid, optionally evacuating the bed, and sealing the bed. The adsorption bed would not have to be evacuated, since its initial exposure to space would perform this evacuation and any excess working fluid would evaporate at that time as well (providing cooling) Examples of potential working fluids are given in Table 1.

TABLE 1

Cooling (Energy absorbed) by desorption and venting to space

| Adsorbent | Compound Desorbed | Cooling Capacity kJ/kg |
|---|---|---|
| FeTi | $H_2$ ($FeTiH_2$) | 516* |
| $LaNi_5$ | $H_2$ ($LaNiH_6$) | 206* |
| Molecular Sieve Zeolite 4A | MeOH (methanol) | 312 |
| Molecular Sieve Zeolite 4A | $H_2O$ (water) | 752 |
| Silica Gel 0.36 Void Volume | MeOH (methanol) | 463 to 1043 |
| Silica Gel 0.46 Void Volume | MeOH (methanol) | 558 to 1257 |
| Silica Gel 0.36 Void Volume | $H_2O$ (water) | 614 to 1536 |
| Silica Gel 0.46 Void Volume | $H_2O$ (water) | 732 to 1831 |

TABLE 1-continued

Cooling (Energy absorbed) by desorption and venting to space

| Adsorbent | Compound Desorbed | Cooling Capacity kJ/kg |
|---|---|---|

*Metal hydride cooling example which demonstrates the cooling advantages of desorption in accordance with the present invention in comparison with a metal hydride bed material.

Figure 16:
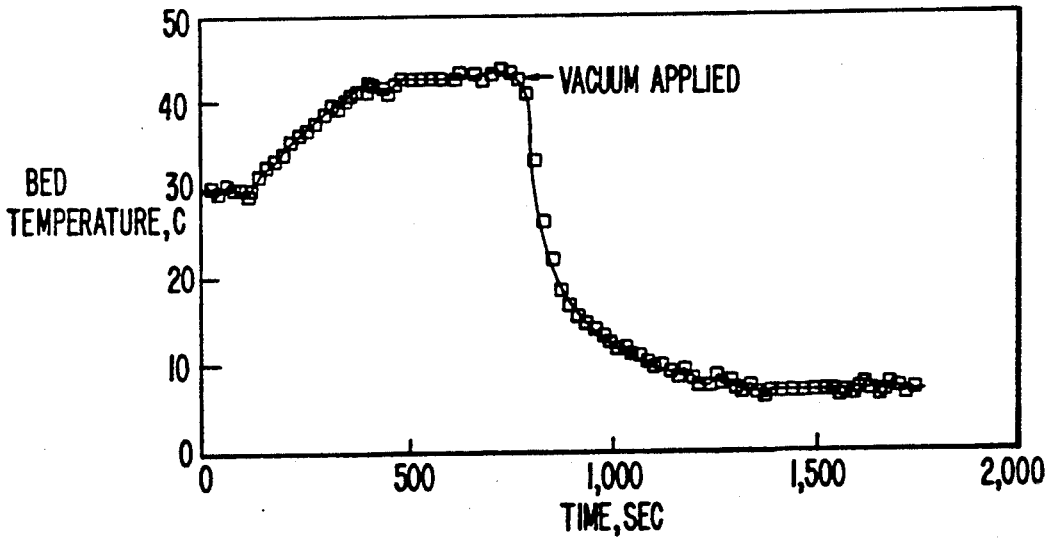
FIG. 16 is a time-temperature graph showing temperature change with adsorption and desorption of methanol working fluid from a zeolite molecular sieve.

These examples indicate that cooling of up to 1.831 kJ/kg can be provided by the proposed desorption scheme (desorbing water from silica gel). FIG. 16 shows the results of desorbing methanol from zeolite molecular sieve 4A referred to in Table 1. In this example, a bed of the zeolite molecular sieve 4A was saturated with methanol and then a vacuum was applied. The temperature of the adsorption bed rapidly dropped from 43° C. to 6° C. in 5 minutes, as shown in FIG. 16.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A cooling device comprising means for permitting transfer of water vapor from a first surface;

means for adsorbing the water vapor and transferring heat of adsorption toward a second surface; and means for resisting flow of the heat of adsorption toward the first surface, wherein the adsorbing means is a desiccant layer and the transfer permitting means is an open cell material.

2. The cooling device according to claim 1, wherein the adsorbing means is a molecular sieve layer.

3. The cooling device according to claim 1, wherein the adsorbing means is a desicaant material.

4. The cooling device according to claim 3, wherein the desiccant material is one of a powder and pellets.

5. A cooling device comprising means for permitting transfer of water vapor from a first surface;

means for adsorbing the water vapor and transferring heat of adsorption toward a second surface; and means for resisting flow of the heat of adsorption toward the first surface, wherein the resisting means and the transfer permitting means are incorporated in a single layer of material.

6. The cooling device according to claim 5, wherein the material is an open cell foam.

7. The cooling device according to claim 6, wherein the adsorbing means is a desiccant layer.

8. A cooling device comprising means for permitting transfer of water vapor from a first surface; means for adsorbing the water vapor and transferring heat of adsorption toward a second surface; and means for resisting flow of the heat of adsorption toward the first surface, wherein the transfer permitting means includes a peelable film layer opposed to the first surface.

9. A cooling device comprising means for permitting transfer of water vapor from a first surface;

means for adsorbing the water vapor and transferring heat of adsorption toward a second surface; and means for resisting flow of the heat of adsorption toward the first surface, wherein the adsorbing means includes a surface with an adhesive opposed to the second surface.

10. The cooling device according to claim 9, wherein the transfer permitting means includes a peelable film layer opposed to the first surface.

11. The cooling device according to claim 10, wherein the three-mentioned means are associated in at least two separate pouches.

12. The cooling device according to claim 11, wherein the transfer permitting means is an open cell material.

13. The cooling device according to claim 12, wherein the adsorbing means is a desiccant material.

14. The cooling device according to claim 13, wherein the first surface is a person's skin and the second surface is a material forming a sealed garment worn by a person.

* * * * *